US007143517B2

(12) United States Patent
Kappes et al.

(10) Patent No.: US 7,143,517 B2
(45) Date of Patent: Dec. 5, 2006

(54) CLEANING DEVICE FOR A SHAVING APPARATUS

(75) Inventors: Diana Kappes, Eppstein (DE); Andreas Larscheid, Kelkheim (DE); Uwe Ludäscher, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/234,020

(22) Filed: Sep. 23, 2005

(65) Prior Publication Data

US 2006/0053642 A1 Mar. 16, 2006

Related U.S. Application Data

(63) Continuation of application No. PCT/EP04/01387, filed on Feb. 13, 2004.

(30) Foreign Application Priority Data

Apr. 4, 2003 (DE) ..... 103 15 455

(51) Int. Cl.
*B26B 19/38* (2006.01)
*B08B 3/04* (2006.01)
*A45D 27/46* (2006.01)

(52) U.S. Cl. ..... 30/538; 30/537; 134/104.2; 206/208

(58) Field of Classification Search ..... 30/41, 30/41.5, 537, 538; 132/286, 289, 292; 206/208; 15/104.92; 134/111, 104.2
See application file for complete search history.

(56) References Cited

U.S. PATENT DOCUMENTS

| | | | | |
|---|---|---|---|---|
| 1,189,118 | A * | 6/1916 | Jonas | 206/208 |
| 1,868,904 | A * | 7/1932 | Johnston | 206/208 |
| 2,027,899 | A * | 1/1936 | Bruce | 30/541 |
| 2,081,488 | A * | 5/1937 | Franz | 30/36 |
| 2,987,036 | A * | 6/1961 | Anderson | 118/268 |
| 3,019,494 | A * | 2/1962 | Horie et al. | 206/208 |
| 3,032,939 | A * | 5/1962 | Andersen | 451/446 |
| 3,172,416 | A | 3/1965 | Simmons | 134/111 |
| 3,801,279 | A * | 4/1974 | Grieco | 312/31 |
| 5,077,900 | A * | 1/1992 | Jamentz | 30/326 |
| 6,257,247 | B1 * | 7/2001 | Benzinger | 132/200 |
| 6,634,492 | B1 * | 10/2003 | Cox | 206/208 |
| 6,792,960 | B1 * | 9/2004 | Peele et al. | 134/104.2 |

FOREIGN PATENT DOCUMENTS

| | | |
|---|---|---|
| DE | 690 21 898 | 1/1990 |
| DE | 44 02 238 | 1/1994 |
| EP | 0 664 973 | 1/1995 |
| EP | 0 743 883 | 6/1999 |
| WO | WO 00/64300 | 11/2000 |
| WO | WO 2004/086899 A1 * | 10/2004 |

* cited by examiner

*Primary Examiner*—Hwei-Siu Payer
(74) *Attorney, Agent, or Firm*—Fish & Richardson P.C.

(57) ABSTRACT

A cleaning device for a shaving apparatus, includes a container for receiving the shaving apparatus. The container is at least partially filled with a cleaning fluid. The device of the invention also includes a device to limit the immersion depth of the shaving apparatus in the container dependent on the level of the cleaning fluid.

34 Claims, 4 Drawing Sheets

CLEANING DEVICE FOR A SHAVING APPARATUS

CLAIM OF PRIORITY

Under 35 U.S.C. § 120, this application is a continuation and claims the benefit of International application serial no. PCT/EP2004/001387, filed Feb. 13, 2004, which is claims the benefit of a foreign priority application under 35 USC § 119(e), filed in Germany, serial number 103 15 455.8, filed Apr. 4, 2003, the entire contents of which are hereby incorporated by reference.

TECHNICAL FIELD

This invention relates to a cleaning device for a shaving apparatus.

BACKGROUND

Cleaning devices for shaving apparatus are used for the removal of particles of hair and other debris adhering in the shaving head section. Such cleaning devices can be manually or electrically operated.

For example, the manually operated cleaning device disclosed by EP 0 743 883 B1 has two containers for a flushing fluid. One container has a variable volume such that the flushing fluid can be pumped between the containers by varying the volume. The shaving unit is arranged in a receptacle between the containers and can be flushed in the current of fluid. The fluid passes through a filter which retains debris.

U.S. Pat. No. 3,172,416 discloses a cleaning device for an electric razor which has a casing with an access opening for receiving the cutter portion of the razor. The casing accommodates a motor-driven fluid impelling assembly for generating a circulating current of a cleaning fluid, and a collector for accumulating hair and other particles. For cleaning, cleaning fluid is flushed through the cutter portion while, at the same time, the razor which is connected to the cleaning device is set in operation.

DE 44 02 238 C2 discloses a cleaning device for the shaving head of a dry shaver. The cleaning device includes a receptacle for the shaving head of the shaving apparatus and at least one cleaning fluid reservoir. The receptacle is disposed above the level of the cleaning fluid and is adapted to be supplied with cleaning fluid from the cleaning fluid reservoir by means of a motor-driven pumping device. The receptacle is connected with the cleaning fluid reservoir via an overflow device and/or via at least one outlet opening.

DE 690 21 898 T2 discloses a dry shaving apparatus with a drivable shaving member and a separately drivable vibratory device. The vibratory device serves to dislodge hair particles and other debris adhering to the shaving member or other parts of the shaving apparatus. The vibratory device is put in operation by reversing the direction of rotation of the electric motor of the shaving apparatus compared to the direction of rotation used in shaving mode. During this reversed direction of rotation, a vibrating motion is produced by means of a claw coupling which, during operation of the motor in the normal direction of rotation, drives the shaving member. A polarity-reversing switch for reversing the direction of rotation is provided on the shaving apparatus. It is also possible for the electric motor to be put in operation automatically in the reversed direction of rotation for a short period after the shaving apparatus is switched off. Very good cleaning results are sometimes possible with these cleaning devices. However, they are of relatively elaborate design and/or awkward to operate.

It is an object of the present invention to provide a cleaning device for a shaving apparatus such that it can be manufactured economically and provides effective cleaning with an acceptable level of user-friendliness.

SUMMARY

In one aspect, the cleaning device of the invention for a shaving apparatus has a container for receiving the shaving apparatus. In operation, the container is typically at least partially filled with a cleaning fluid. The cleaning device features a device to limit the immersion depth of the shaving apparatus in the container dependent on the level of the cleaning fluid.

The advantage of this cleaning device is that good cleaning can be achieved at relatively little expense. It is particularly advantageous that no pumping device is needed for the cleaning fluid and also that no other electrical or electronic components are required. The limiting device regulates the level of cleaning fluid which contacts the shaving apparatus, independent of the level of cleaning fluid in the container. A further advantage resides in the easy operation of the cleaning device. Finally, it is also an advantage that operation of the cleaning device of the invention results in only little circulation of the cleaning fluid, thus enabling the particles of hair and other debris dislodged from the shaving apparatus to settle as sediment so that a relatively clean cleaning fluid is available for each cleaning operation.

In a one embodiment, the device for limiting the depth of immersion is constructed as a float arranged in the container. The float is an easy, economical, and reliable way to limit the depth of immersion. The float may be provided with a trough-type well for the shaving apparatus. The well may lead into at least one through-flow opening for the cleaning fluid, the through-flow opening extending all the way through the float. It is particularly advantageous for the deepest point of the well to lead into the through-flow opening or into one of the through-flow openings. This allows the cleaning fluid to flow in and out unimpeded and increases the likelihood that particles of hair or other debris dislodged from the shaving apparatus will, for the most part, exit the well and settle in the container. With a view to the level of fluid developing in its well, the float is preferably dimensioned such that the shaving apparatus is wetted with cleaning fluid up to a predetermined level. Hence, the float can be configured to predetermine which section of the shaving apparatus is to be cleaned. For example, the cleaning device may be constructed such that the level of fluid required for the predetermined level of wetting develops in the well of the float when the float is loaded with the shaving apparatus. Similarly, it is also possible for the required level of fluid to be reached by the dead weight of the float. In this embodiment, the cleaning device of the invention may include a locking device for locking the float in position relative to the container.

The cleaning device may have a holding device capable of holding the shaving apparatus in a fixed position above the container. The holding device may be used for drying the shaving apparatus after the cleaning operation.

In one embodiment, the locking device is activatable by the holding device. For this purpose, the holding device may have a face constructed in the manner of a ramp, for example, which cooperates with a locking element. The holding device may be constructed, for example, to be vertically displaceable between an upper and a lower position and the float may include a device for limiting the downward movement of the holding device.

It is also possible for the cleaning device to be provided with a parking well for the shaving apparatus. It is then possible to dispense with a holding device as a drying stand for the shaving apparatus.

In all embodiments of the cleaning device of the invention, the container may have a viewing window for reading off the level of the cleaning fluid. Such a fluid level indicator can be constructed with little expense and is very reliable and precise.

The invention also relates to a system comprising a shaving apparatus and the cleaning device of the invention for cleaning the shaving apparatus. For example, the shaving apparatus can have an actuating device for activating a cleaning function that puts the shaving apparatus into operation temporarily during the cleaning cycle.

The advantage of the system of the invention is that the shaving apparatus can be equipped with a cleaning program optimally suited for its type of construction and that the expense for implementing the cleaning program on the cleaning device can be avoided. In particular, the cleaning device can make do without any electrical or electronic components as the control function is performed by the shaving apparatus.

The actuating device may be designed for manual operation. It is also possible for the actuating device to be designed for operation via the cleaning device and, hence, for the grip otherwise necessary for operating the actuating device to be dispensed with.

In one method for cleaning a shaving apparatus, the shaving apparatus is immersed in a container which is filled at least partially with a cleaning fluid. The particular feature of this method is that the depth of immersion of the shaving apparatus in the container is limited dependent on the level of the cleaning fluid. Preferably, the shaving apparatus is inserted in a well formed in a float, which well is filled with cleaning fluid up to a predetermined level during the cleaning cycle. The float can be locked either before or while the shaving apparatus is inserted.

The present invention will be explained in the following with reference to the embodiments illustrated in the accompanying drawings, each embodiment referring to a manual cleaning device. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
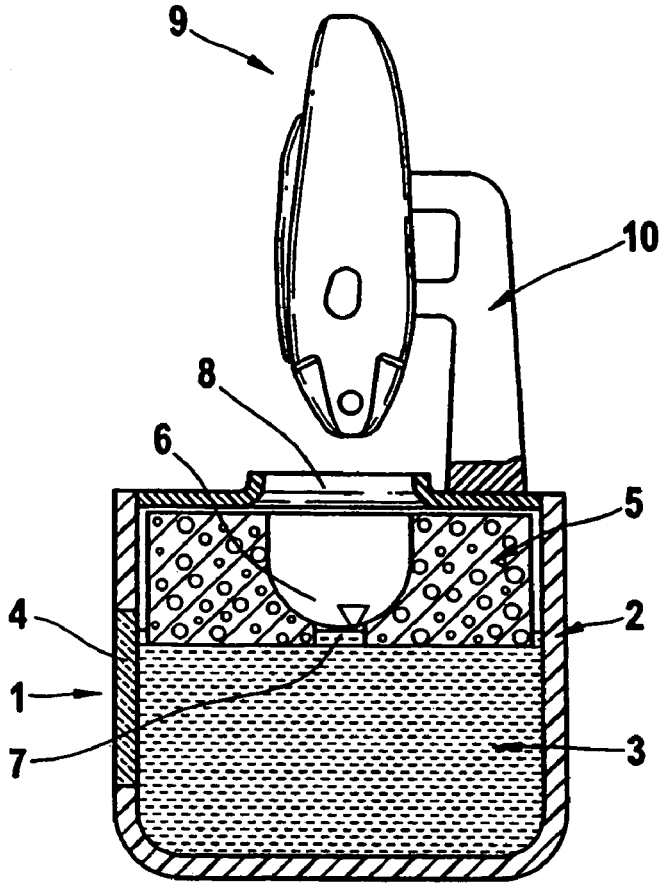
FIG. 1 is a sectional view of a cleaning device showing a shaving apparatus in drying position.

FIG. 1 shows a cleaning device 1 that includes a cartridge 2 for holding a supply of a cleaning fluid 3. A viewing window 4 for reading off the level of the cleaning fluid 3 is embedded in a side wall of the cartridge 2. A float 5 made from a buoyant material such as polystyrene is inside the cartridge 2. The float 5 has a trough-shaped well 6 which is open in the direction of the top of the cartridge 2. At its deepest point, the well 6 leads into a through-flow opening 7 which extends all the way through the float 5. Through-flow opening 7 enables the cleaning fluid 3 to flow into the well 6 or out of the well 6 as the depth of immersion of the float 5 changes. Similarly, it is also possible to provide several through-flow openings 7. At its upper end, the cartridge 2 has a receiving opening 8 for an electric shaving apparatus 9. The lateral positions of the receiving opening 8 of the cartridge 2 and of the well 6 of the float 5 are coordinated such that the receiving opening 8 is arranged above the well 6. The shaving apparatus 9 is fastened to a holding device 10, which is arranged on the top side of the cartridge 2. The holding device 10 is constructed such that it holds the shaving apparatus 9 in a fixed position above the receiving opening 8 of the cartridge 2 and hence also above the well 6 of the float 5. This position is referred to in the following as the drying position because the shaving apparatus 9 is moved to this position after the cleaning operation for drying.

Figure 2:
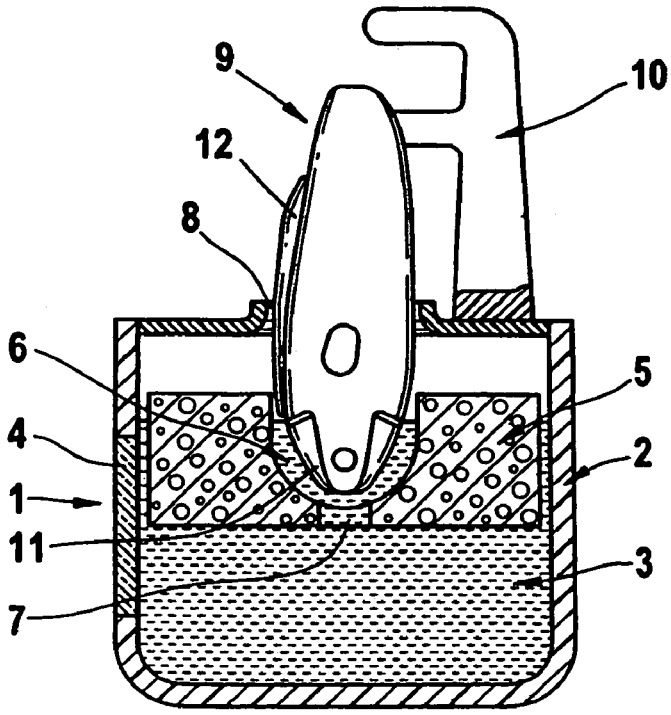
FIG. 2 is a sectional view of the cleaning device of FIG. 1, showing a shaving apparatus in cleaning position.

Referring to FIG. 2, during the cleaning operation, the shaving apparatus 9 is inserted with a section of its shaving head 11 into the receiving opening 8 of the cartridge 2 with the result that the shaving head 11 is placed in the well 6 of the float 5 and the shaving apparatus 9 is supported by the float 5. Prior to this, a cover, not illustrated, is removed from the receiving opening 8 where applicable. The weight of the shaving apparatus 9 increases the depth of immersion of the float 5 and the shaving apparatus 9 sinks deeper into the cartridge 2. At the same time, the cleaning fluid 3 flows through the through-flow opening 7 into the well 6 of the float 5, causing the level of liquid in the well 6 to rise. At a certain depth of immersion, a state of equilibrium is achieved between weight force and buoyant force, with the result that the float 5 with the shaving apparatus 9 remains in this position and the level of fluid in the well 6 of the float adapts to the fluid level in the cartridge 2. In the state of equilibrium, the shaving head 11 of the shaving apparatus 9 is wetted with the cleaning fluid 3 up to a defined level. The wetting of the shaving head 11 is independent of the level of cleaning fluid 3 in the cartridge 2 because changes of the level are compensated for by the float 5. In the presence of a high fluid level, the float 5 is in the upper section of the cartridge 2, with the result that the shaving apparatus 9 sinks only slightly into the cartridge 2. With a low fluid level, the float 5 is in the lower section of the cartridge 2, with the result that the shaving apparatus 9 sinks deeply into the cartridge 2. Hence, the depth of immersion of the shaving apparatus 9 into the cartridge 2 is limited by the float 5 to a value which is dependent on the level of the cleaning fluid 3, with the level of fluid in the well 6 of the float 5 when loaded with the shaving apparatus 9 being always the same. Thus, the shaving head 11 of the shaving apparatus 9 is wetted with the cleaning fluid 3 up to the same level.

To perform the cleaning, the shaving apparatus 9 in the cleaning position shown in FIG. 2 is put into operation for about one to two minutes after a brief soaking period. The soaking period is calculated to enable effective cleaning of the shaving head 11 in the subsequent operating stage without unnecessarily prolonging the time required overall for the cleaning cycle. The shaving apparatus 9 can be implemented in a variety of ways. In the embodiment shown in FIG. 2, the shaving apparatus 9 is switched on and, after a desired time period, is switched off again manually using a switch 12 that is also used for switching the shaving apparatus 9 on and off for shaving purposes. In a variation, not illustrated, provision is made on the shaving apparatus 9 for a cleaning button in addition to the switch 12 which activates a cleaning program with which the shaving apparatus 9 is put into operation automatically for one or several time periods after manual operation of the cleaning button. In some instances, a soaking period is provided between the operating stages. In another variation, the shaving apparatus 9 is equipped with an actuating device to activate the cleaning program, which is automatically operated by the cleaning device 1 when the shaving head 11 is inserted in the receiving opening 8 of the cartridge 2, with the result that the cleaning program is started automatically.

Regardless of how it is done in a particular case, putting the shaving apparatus 9 into operation can result in an intensive cleaning effect and particles of hair and other debris can be removed from the section of the shaving head 11. This effect is due to relative movement between the cleaning fluid 3 and the components of the shaving head 11, which is generated with the aid of the drive motor of the shaving apparatus 9. This obviates the need to equip the cleaning device 1 with an electrically driven pumping device for the cleaning fluid 3. The dislodged particles of hair and debris can sink through the through-flow opening 7 to the bottom of the cartridge 2. The cleaning cycle can be optimized with regard to the cleaning result and the time required overall for the cleaning by varying the length of operating times for the shaving apparatus 9 and the soaking times in between.

On completion of the cleaning cycle, the shaving apparatus 9 is removed from the cartridge 2 and fixed to the holding device 10 such that the shaving head 11 is arranged above the receiving opening 8 of the cartridge 2. In this position, it is possible, for example, for any remnants of the cleaning fluid 3 remaining on the shaving head 11 to drip into the cartridge 2. When the shaving apparatus 9 is taken out of the well 6 of the float 5, the depth of immersion of the float 5 decreases in response to the reduced load. At the same time, a part or, depending on the construction of the float 5, all of the cleaning fluid 3 present in the float flows together with contained particles of hair and debris through the through-flow opening 7 out of the well 6 of the float 5. The particles of hair and debris settle to the bottom of the cartridge 2, with the result that the cleaning fluid 3 is available in relatively clean condition for the next cleaning cycle.

Figure 3:
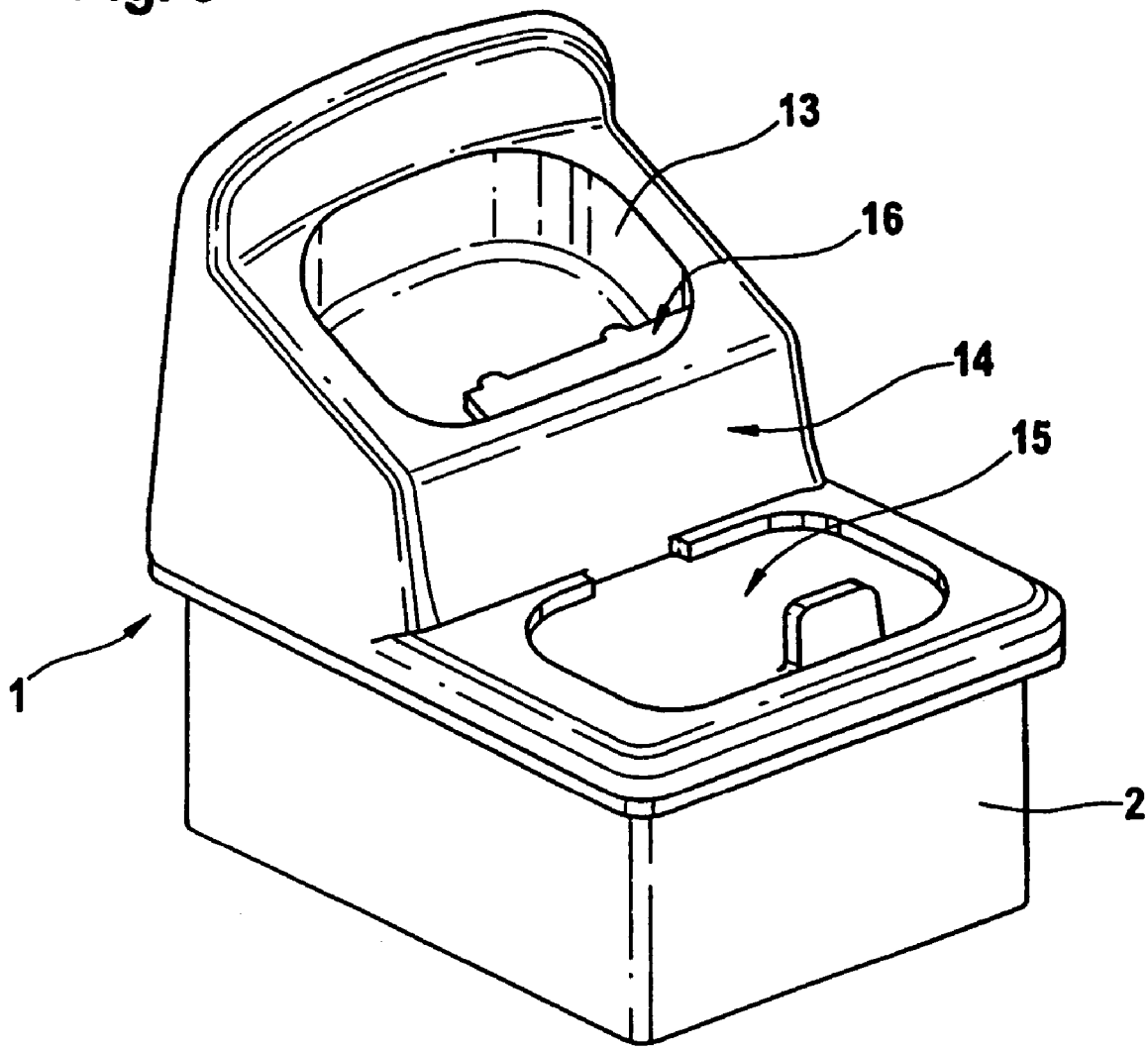
FIG. 3 is a perspective view of a second embodiment of a cleaning device of the invention, absent a shaving apparatus.
Figure 4:
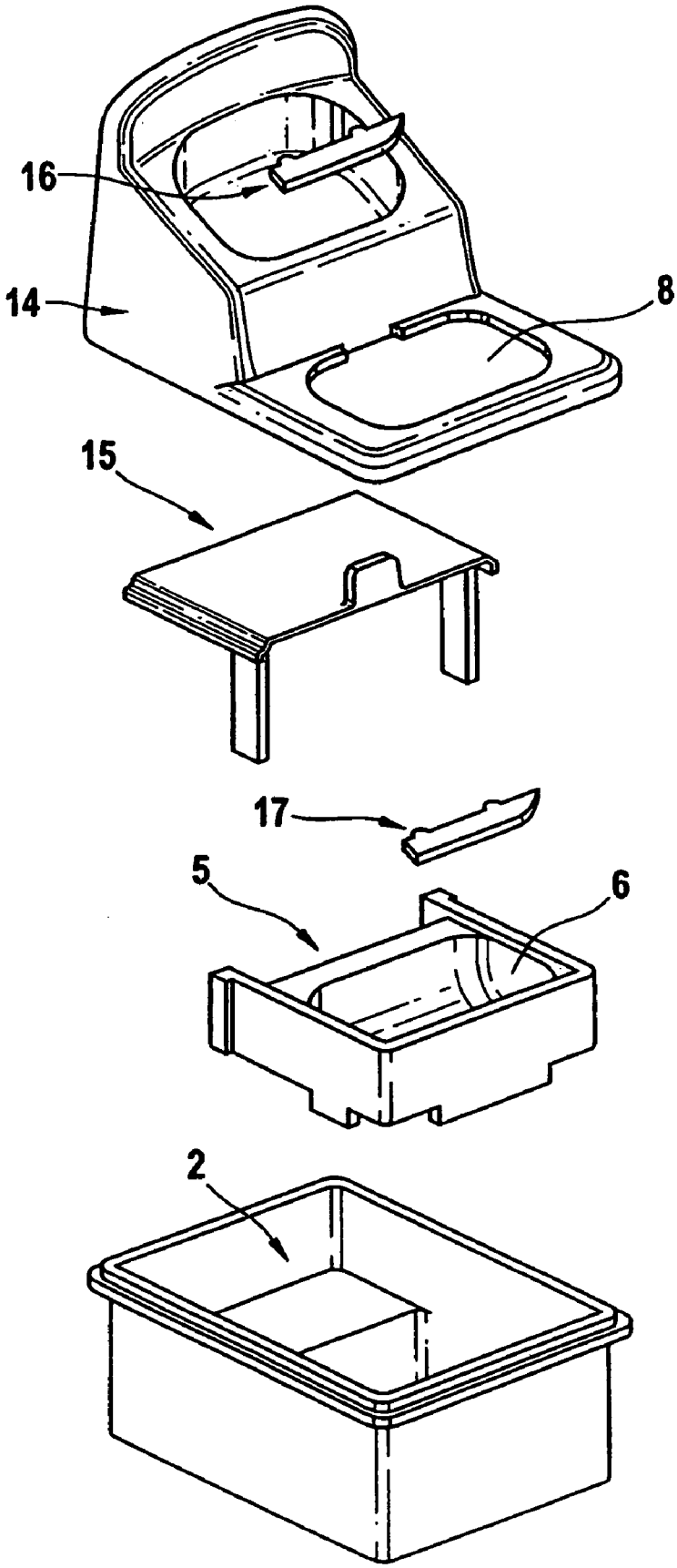
FIG. 4 is a perspective exploded view of the embodiment of FIG. 3.

FIGS. 3 and 4 show a second embodiment of cleaning device 1. Features of the second embodiment largely correspond to those of the first embodiment. Primary differences are in design with respect to the concept for drying the shaving apparatus 9. For example, the second embodiment does not have the holding device 10 for holding the shaving apparatus 9 in a fixed position above the receiving opening 8 of the cartridge 2, but it has a parking well 13 adapted to accommodate the shaving apparatus 9 for drying. The parking well 13 is integrated in an upper part 14 of the cleaning device 1, which is arranged on top of the cartridge 2. The parking well has a drain, not shown in FIGS. 3 and 4, for the discharge of fluid into the cartridge 2. The receiving opening 8 is also integrated in the upper part 14 and arranged on a lower plane adjacent to the parking well 13. The receiving opening 8 can be closed with a sliding lid 15. To prevent damage to the shaving head 11 and to ensure a safe seat, a first rubber rest 16 for the shaving apparatus 9 is arranged in the parking well 13. A second rubber rest 17 is arranged in the well 6 of the float 5 for the same reasons. Although not specifically depicted, the viewing window 4 provided in the first embodiment for observing the level of the cleaning fluid 3 in the cartridge 2 may also be present in the second embodiment.

To clean the shaving apparatus 9, the sliding lid 15 is opened by sliding it side-ways. The shaving apparatus 9 is then inserted, with the shaving head 11 to the fore, into the receiving opening 8, and arranged in the well 6 of the float 5. The cleaning operation takes place in a similar manner to that described with reference to the first embodiment shown in FIGS. 1 and 2. Upon completion of the cleaning cycle, the shaving apparatus 9 is taken out of the well 6 of the float 5 and deposited in the parking well 13 for drying. The receiving opening 8 is then closed with the sliding lid 15.

Figure 5:
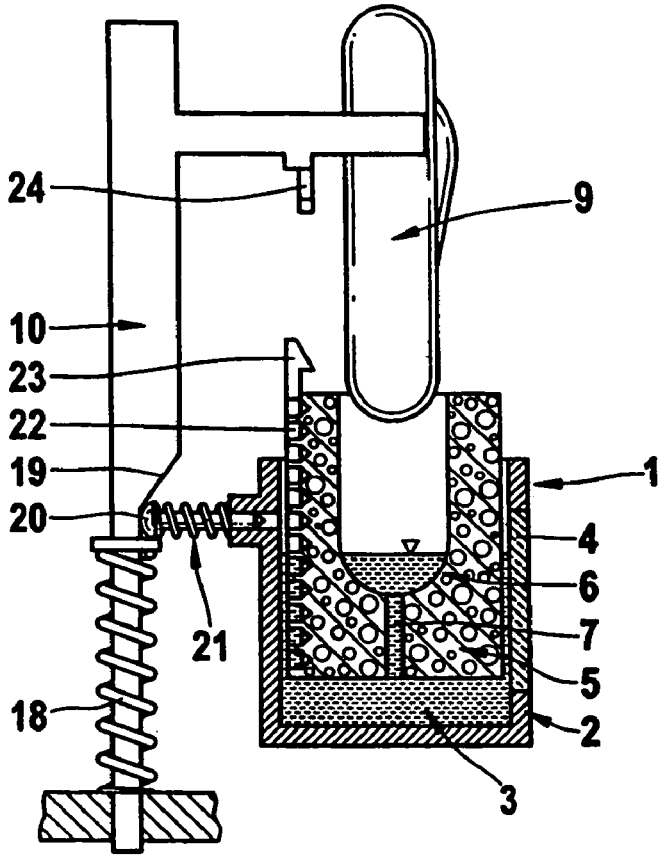
FIG. 5 is a sectional view of a third embodiment of a cleaning device showing a shaving apparatus in drying position.

FIG. 5 shows a third embodiment of the cleaning device 1 with the shaving apparatus 9 is in the drying position. The shaving apparatus 9 is fixedly held in the holding device 10, which in this embodiment is of the vertically adjustable. A lift spring 18 biases the holding device 10 in the direction of the drying position, which also represents the upper limit position of the holding device 10. The third embodiment primarily differs from the first and second embodiments in that the float 5 is constructed such that its dead weight alone sets the depth of immersion to that which is required for wetting the shaving head 11 up to the desired level. Furthermore, the third embodiment includes a locking mechanism enabling the float 5 to be fixed in its vertical position. The locking mechanism is comprised of a bevel 19 formed on the holding device 10, which cooperates with a pin 20 that is horizontally slidably mounted in the side wall of the cartridge 2. The pin 20 is biased against the bevel 19 by means of a pressure spring 21 and engages in a perforated member 22 on the side of the float 5 upon overcoming the spring force of the pressure spring 21. The float 5 also has on its upper side a hook 23 adapted to be hooked in an eyelet 24 formed on the holding device 10.

In the drying position shown in FIG. 5, the pin 20 is out of engagement with the perforated member 22 of the float 5, and the hook 23 of the float 5 is not hooked in the eyelet 24 of the holding device 10. Consequently, the float 5 is movable in vertical direction and thus adopts a vertical position that is dependent on the level of cleaning fluid 3 in the cartridge 2. The well 6 of the float 5 is filled with cleaning fluid 3, which is allowed to flow through the through-flow opening 7, up to a level which is predetermined by the depth of immersion of the float 5 and independent of the level of the cleaning fluid 3 in the cartridge 2.

To clean the shaving apparatus 9, it is first held in a fixed position on the holding device 10 in the drying position shown in FIG. 5. The holding device 10 with the shaving apparatus 9 inserted is lowered until the cleaning position shown in FIG. 6 is reached.

Figure 6:
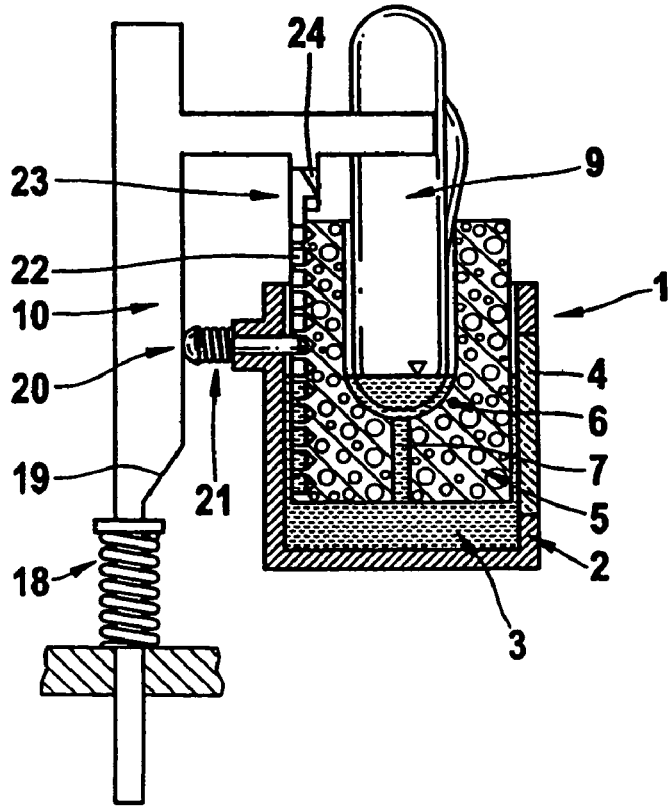
FIG. 6 is a sectional view of the embodiment of FIG. 5, showing the shaving apparatus in cleaning position.

FIG. 6 shows the embodiment of FIG. 5 with the shaving apparatus 9 in cleaning position. When the holding device 10 with the shaving apparatus 9 held therein is lowered into the cleaning position, the pin 20 is urged by the action of the bevel 19 into the perforated member 22 and thus locks the float 5 in the current vertical position. Upon reaching the cleaning position, the hook 23 of the float 5 impacts against the holding device 10 in the area of the eyelet 24 and prevents the holding device 10 from being lowered any further. At the same time, the hook 23 automatically snaps in into the eyelet 24 of the holding device 10. As the float 5 is locked by the pin 20 against the cartridge 2, the snapping in of the hook 23 also fixes the holding device 10 in respect of its vertical position in addition to the float 5. In this position, the shaving apparatus 9 is immersed with its shaving head 11 in the cleaning fluid 3 up to the desired level. As previously described with reference to the first embodiment, the shaving apparatus 9 can be put in operation, either manually or automatically in order to achieve an optimum cleaning effect. The particles of hair or debris dislodged from the shaving head 11 in the process sink, at least in part, through the through-flow opening 7 onto the bottom of the cartridge 2. On completion of the cleaning cycle, the hook 23 is manually disengaged from the eyelet 24 with the result that the holding device 10 together with the shaving apparatus 9 is raised into the drying position by the lift spring 18. As this occurs, the pin 20 slides over the bevel 19 and, through the action of the pressure spring 21, moves increasingly away from the float 5 so that it is ultimately released by the perforated member 22 and the float 5 is unlocked. The shaving apparatus 9 may remain for a while in the drying position for the cleaning fluid to drip off and dry.

As becomes apparent from the foregoing, the float 5 on the third embodiment does not move while the shaving apparatus 9 is transferred from the drying position into the cleaning position and back again. Nevertheless, the float 5 limits the movement of the holding device 10 and hence also the depth of immersion of the shaving apparatus 9 in the cartridge 2 during transfer into the cleaning position dependent on the level of fluid in the cartridge 2. This results from the fact that the vertical position of the float 5 in the non-locked state depends on the level of the cleaning fluid 3 in the cartridge 2 and that the hook 23, by means of which the movement of the holding device 10 is limited, is arranged on the float 5.

The principle of operation of the third embodiment, i.e., the locking of the float 5, which through its dead weight alone provides the immersion depth required for wetting the shaving apparatus 9, may also find application in the second embodiment illustrated in FIGS. 3 and 4. For this purpose, the second embodiment is equipped with a suitably dimensioned float and modified such that the float 5 is locked in its current vertical position by opening the sliding lid 15. The lock is canceled again when the sliding lid 15 is closed after removing the shaving apparatus 9 from the receiving opening 8.

A number of embodiments of the invention have been described. Nevertheless, it will be understood that various modifications may be made without departing from the spirit and scope of the invention. Accordingly, other embodiments are within the scope of the following claims.

What is claimed is:

1. A shaving apparatus cleaning device comprising:

a container having a shaving apparatus opening sized to receive a shaving apparatus, the container capable of holding a cleaning fluid; and an insertion depth limiter that limits an insertion depth of the shaving apparatus in the container as a function of a level of the cleaning fluid to a desired shaving apparatus cleaning depth.

2. The cleaning device according to claim 1, wherein the insertion depth limiter comprises a float arranged in the container.

3. The cleaning device according to claim 2, wherein the float defines a cavity sized to receive the shaving apparatus.

4. The cleaning device according to claim 3, wherein the float further defines at least one aperture which extends from the cavity to an opposite side of the float.

5. The cleaning device according to claim 4, wherein a first aperture of the at least one apertures is located extending from the cavity at the point in which cleaning fluid in the cavity is deepest.

6. The cleaning device according to claim 3, wherein the float is dimensioned and configured such that, when the container holds cleaning fluid above a minimum level, a predetermined level of the cleaning fluid is present in the cavity.

7. The cleaning device according to claim 6, wherein the predetermined level of cleaning fluid is present in the cavity of the float when the float is loaded with the shaving apparatus.

8. The cleaning device according to claim 6, further comprising a locking device for fixing the position of the float relative to the container.

9. The cleaning device according to claim 8, further comprising a holding device capable of holding the shaving apparatus in a fixed position above the container.

10. The cleaning device according to claim 9, wherein the locking device is activatable by the holding device.

11. The cleaning device according to claim 10, wherein the holding device has an angled face which engages a locking element.

12. The cleaning device according to claim 9, wherein the holding device is vertically displaceable between an upper and a lower position.

13. The cleaning device according to claim 12, wherein the float includes a device for limiting the downward movement of the holding device.

14. The cleaning device according to claim 9, further comprising a parking well for the shaving apparatus.

15. The cleaning device according to claim 2, wherein the container has a viewing window for observing the level of the cleaning fluid in the container.

16. A shaver system comprising:

a shaving apparatus: and a shaving apparatus cleaning device, the cleaning device including:

a container for receiving the shaving apparatus, the container capable of holding a cleaning fluid; and an insertion depth limiter adjustably received in the container and communicating with cleaning fluid in the container, a position of the insertion depth limiter relative to the container automatically adjusted in response to changes in the level of the cleaning fluid in the container to limit an insertion depth of the shaving apparatus in the container;

wherein the shaving apparatus has an actuating device that activates a cleaning function that puts the shaving apparatus into operation during the cleaning cycle.

17. The system according to claim 16, wherein the actuating device is operable manually.

18. The system according to claim 16, wherein the actuating device is operable via the cleaning device.

19. A method for cleaning a shaving apparatus; the method comprising:

providing a shaving apparatus cleaning device, the cleaning device including:

a container for receiving the shaving apparatus, the container capable of holding a cleaning fluid; and an insertion depth limiter adjustably received in the container and communicating with cleaning fluid in the container, a position of the insertion depth limiter relative to the container automatically adjusted in response changes in the level of the cleaning fluid in the container to limit an insertion depth of the shaving apparatus in the container; and inserting the shaving apparatus into the container.

20. The method according to claim 19, wherein the insertion depth limiter comprises a float arranged in the container, the float defining a cavity sized to receive the shaving apparatus; and the step of inserting the shaving apparatus into the container comprises inserting the shaving apparatus into the cavity which is filled with cleaning fluid up to a predetermined level during the cleaning cycle.

21. The method according to claim 20, further comprising engaging a locking device for fixing the position of the float relative to the container.

22. A shaving apparatus cleaning device comprising:

a container configured to receive a shaving apparatus inserted therein, the container capable of holding a cleaning fluid; and an insertion depth limiter that limits an insertion depth of the shaving apparatus in the container as a function of a level of the cleaning fluid, the insertion depth limiter comprising a float arranged in the container;

the float defining a cavity sized to receive the shaving apparatus and defining at least one aperture which extends from the cavity to an opposite side of the float; wherein a first aperture of the at least one apertures is located extending from the cavity at the point in which cleaning fluid in the cavity is deepest.

23. The cleaning device according to claim 22, further comprising a locking device for fixing the position of the float relative to the container.

24. The cleaning device according to claim 23, further comprising a holding device capable of holding the shaving apparatus in a fixed position above the container.

25. The cleaning device according to claim 24, wherein the holding device is vertically displaceable between an upper and a lower position.

26. The cleaning device according to claim 25, wherein the float includes a device for limiting the downward movement of the holding device.

27. A shaving apparatus cleaning device comprising:

a container configured to receive a shaving apparatus inserted therein, the container capable of holding a cleaning fluid; and an insertion depth limiter that limits an insertion depth of the shaving apparatus in the container as a function of a level of the cleaning fluid, the insertion depth limiter comprising a float arranged in the container;

the float defining a cavity sized to receive the shaving apparatus;

wherein the float is dimensioned and configured such that, when the container holds cleaning fluid above a minimum level, a predetermined level of the cleaning fluid is present in the cavity.

28. The cleaning device according to claim 27, wherein the predetermined level of cleaning fluid is present in the cavity of the float when the float is loaded with the shaving apparatus.

29. The cleaning device according to claim 27, further comprising a locking device for fixing the position of the float relative to the container.

30. The cleaning device according to claim 29, further comprising a holding device capable of holding the shaving apparatus in a fixed position above the container.

31. The cleaning device according to claim 30, wherein the locking device is activatable by the holding device.

32. The cleaning device according to claim 31, wherein the holding device has an angled face which engages a locking element.

33. The cleaning device according to claim 30, wherein the holding device is vertically displaceable between an upper and a lower position.

34. The cleaning device according to claim 33, wherein the float includes a device for limiting the downward movement of the holding device.

* * * * *